US011527853B2

(12) United States Patent
Hsu et al.

(10) Patent No.: US 11,527,853 B2
(45) Date of Patent: Dec. 13, 2022

(54) ELECTRICAL CONNECTOR WITH CONNECTED CONTACT PORTIONS ON UPPER SURFACES AND LOWER SURFACES OF A TONGUE PORTION

(71) Applicant: Cheng Uei Precision Industry Co., LTD., New Taipei (TW)

(72) Inventors: Li-Nien Hsu, New Taipei (TW); Sheng-Nan Yu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/357,967

(22) Filed: Jun. 24, 2021

(65) Prior Publication Data

US 2022/0247128 A1 Aug. 4, 2022

(30) Foreign Application Priority Data

Feb. 1, 2021 (CN) ..... 202120284400.5

(51) Int. Cl.

| | |
|---|---|
| ***H01R 13/642*** | (2006.01) |
| ***H01R 13/6581*** | (2011.01) |
| ***H01R 13/652*** | (2006.01) |
| ***H01R 13/629*** | (2006.01) |
| ***H01R 24/00*** | (2011.01) |
| ***H01R 24/60*** | (2011.01) |
| *H01R 13/6471* | (2011.01) |
| *H01R 13/648* | (2006.01) |
| *H01R 13/40* | (2006.01) |

(52) U.S. Cl.

CPC ..... *H01R 13/642* (2013.01); *H01R 13/629* (2013.01); *H01R 13/652* (2013.01); *H01R 13/6581* (2013.01); *H01R 24/00* (2013.01); *H01R 24/60* (2013.01); *H01R 13/40* (2013.01); *H01R 13/648* (2013.01); *H01R 13/6471* (2013.01)

(58) Field of Classification Search

CPC .. H01R 13/642; H01R 13/629; H01R 13/652; H01R 13/6581; H01R 13/6471; H01R 13/648; H01R 24/00; H01R 24/60; H01R 13/40

See application file for complete search history.

(56) References Cited

U.S. PATENT DOCUMENTS

2018/0006408 A1* 1/2018 Wen ..... H01R 13/6594

* cited by examiner

*Primary Examiner* — Abdullah A Riyami
*Assistant Examiner* — Justin M Kratt
(74) *Attorney, Agent, or Firm* — Cheng-Ju Chiang

(57) ABSTRACT

An electrical connector includes an insulating housing and a terminal assembly. The insulating housing has a base body. A front surface of the base body extends frontward to form a stepping portion. A front surface of the stepping portion extends frontward to form a tongue portion. The terminal assembly includes at least two ground terminals, at least two power terminals and at least two detecting terminals fastened to the insulating housing. The at least two ground terminals are mounted to two outermost portions of two opposite sides of the tongue portion. The at least two power terminals are mounted to the two opposite sides of the tongue portion. The at least two detecting terminals are disposed in a middle of the tongue portion, and the at least two power terminals surround the at least two detecting terminals.

20 Claims, 3 Drawing Sheets

ELECTRICAL CONNECTOR WITH CONNECTED CONTACT PORTIONS ON UPPER SURFACES AND LOWER SURFACES OF A TONGUE PORTION

CROSS-REFERENCE TO RELATED APPLICATION

The present application is based on, and claims priority from, China Patent Application No. 202120284400.5, filed Feb. 1, 2021, the disclosure of which is hereby incorporated by reference herein in its entirety.

BACKGROUND OF THE INVENTION

1. Field of the Invention

The present invention generally relates to an electrical connector, and more particularly to an electrical connector having a lower manufacturing cost.

2. The Related Art

In various connector types used by various electronic products frequently, universal serial bus (USB) connectors are the most widely applied connectors. With the improvement of science and technology, kinds of the universal serial bus connectors are more and more, such as USB 2.0, USB 3.0, Micro USB, Mini USB or USB Type-C. The USB TYPE-C connectors have been widely applied in the various electronic products.

A conventional connector includes an upper row of terminals and a lower row of terminals, and a contact region which is formed by need of the upper row of the terminals and the lower row of the terminals of the conventional connector, so the upper row of the terminals and the lower row of the terminals of the conventional connector may increase a manufacturing cost of the conventional connector. Or the conventional connector includes an integrally formed terminal. Nevertheless, the conventional connector needs multiple processes for surrounding the terminal to cause a complicated working procedure and a higher cost. The conventional connector further includes a center shielding plate to be buckled with metal buckling arms of a mating connector.

An electrical connector in a prior art, includes a charging module and an outer shell. The electrical connector is a USB 3.0 Type-C power delivery connector. The charging module includes an insulating body and a charging assembly. The insulating body has a base portion, and a tongue portion extended frontward from the base portion. The tongue portion has a first surface and a second surface opposite to each other. The charging assembly includes a plurality of charging terminals disposed in the insulating body. Each charging terminal has a fixing portion mounted to the base portion, a soldering portion extended from one end of the fixing portion and passing through the base portion, and a contact portion extended from the other end of the fixing portion and extending to the tongue portion. Opposite edges of the contact portions of the plurality of the charging terminals are exposed to the first surface and the second surface of the tongue portion, so that the contact portions of the plurality of the charging terminals can be used to abut against two power terminals of the mating connector which is mated with the electrical connector. The outer shell surrounds the charging module. Accordingly, the plurality of the charging terminals are provided for charging electronic devices.

However, the electrical connector described above needs multiple processes to surround the plurality of the charging terminals of the electrical connector, correspondingly, the electrical connector has a complicated process and a higher manufacturing cost. Furthermore, buckling areas of a left side and a right side of the tongue portion of the electrical connector are without metal buckling portions. When the electrical connector is buckled with the mating connector, the metal buckling arms of the mating connector rub against plastic portions of the left side and the right side of the tongue portion of the electrical connector, so after the electrical connector is buckled with the mating connector for multiple times, the plastic portions of the left side and the right side of the tongue portion of the electrical connector are abraded. In addition, because the buckling areas of the left side and the right side of the tongue portion of the electrical connector are without the metal buckling portions, when the electrical connector is buckled with the mating connector, the electrical connector and the metal buckling arms of the mating connector have no way of forming a ground connection between the electrical connector and the mating connector, and electrical characteristics of the electrical connector and the mating connector are affected at the time of the electrical connector being docked with the mating connector.

Thus, in order to overcome disadvantages of the electrical connector described above, it is essential to provide an innovative electrical connector having a lower manufacturing cost.

SUMMARY OF THE INVENTION

An object of the present invention is to provide an electrical connector. The electrical connector includes an insulating housing and a terminal assembly. The insulating housing has a base body. A middle of a front surface of the base body extends frontward to form a stepping portion. A middle of a front surface of the stepping portion extends frontward to form a tongue portion. The tongue portion has a top surface, a bottom surface, and two opposite side surfaces connected between the top surface and the bottom surface. The top surface and the bottom surface are opposite to each other. The terminal assembly includes at least two ground terminals, at least two power terminals and at least two detecting terminals fastened to the insulating housing. The at least two ground terminals are mounted to two outermost portions of two opposite sides of the tongue portion. The at least two power terminals are mounted to the two opposite sides of the tongue portion. The at least two detecting terminals are disposed in a middle of the tongue portion, and the at least two power terminals surround the at least two detecting terminals. Each of the at least two ground terminals and the at least two power terminals has a fastening portion, a contact portion and a soldering portion. The fastening portion of each ground terminal and the fastening portion of each power terminal are fastened in and surrounded by the base body and a rear of the stepping portion of the insulating housing. A front end of the fastening portion of each ground terminal extends frontward to form the contact portion, and a front end of the fastening portion of each power terminal extends frontward to form the contact portion. The contact portion of each ground terminal and the contact portion of each power terminal are surrounded by the tongue portion and a front of the stepping portion of the insulating housing. A rear end of the fastening portion of each ground terminal extends rearward to form the soldering portion, and a rear end of the fastening portion of each power terminal extends rearward to form the soldering portion. The soldering portion of each ground terminal and the soldering portion of each power terminal extend out of a rear end of the base body and project beyond a rear surface of the base body. Each contact portion has an upper contact plate, a lower contact plate located under the upper contact plate and facing the upper contact plate, and a connecting plate connected between the upper contact plate and the lower contact plate. The lower contact plate is parallel to the upper contact plate. Middles of outer surfaces of the connecting plates of the two ground terminals are exposed to the two opposite side surfaces of the insulating housing. The upper contact plate of each ground terminal and the upper contact plate of each power terminal are exposed outside to the top surface of the tongue portion. The lower contact plate of each ground terminal and the lower contact plate of each power terminal are exposed outside to the bottom surface of the tongue portion.

Another object of the present invention is to provide an electrical connector. The electrical connector includes an insulating housing and a terminal assembly. The insulating housing has a base body. A middle of a front surface of the base body extends frontward to form a stepping portion. A middle of a front surface of the stepping portion extends frontward to form a tongue portion. The tongue portion has a top surface, a bottom surface, and two opposite side surfaces connected between the top surface and the bottom surface. The terminal assembly includes at least two ground terminals, at least two power terminals and at least two detecting terminals fastened to the insulating housing. The at least two ground terminals are mounted to two outermost portions of two opposite sides of the tongue portion. The at least two power terminals are mounted to the two opposite sides of the tongue portion. The at least two detecting terminals are disposed in a middle of the tongue portion, and the at least two power terminals surround the at least two detecting terminals. Each of the at least two ground terminals and the at least two power terminals has a fastening portion, a contact portion and a soldering portion. The fastening portion of each ground terminal and the fastening portion of each power terminal are fastened in and surrounded by the base body and a rear of the stepping portion of the insulating housing. A front end of the fastening portion of each ground terminal extends frontward to form the contact portion, and a front end of the fastening portion of each power terminal extends frontward to form the contact portion. The contact portion of each ground terminal and the contact portion of each power terminal are surrounded by the tongue portion and a front of the stepping portion of the insulating housing. A rear end of the fastening portion of each ground terminal extends rearward to form the soldering portion, and a rear end of the fastening portion of each power terminal extends rearward to form the soldering portion. The soldering portion of each ground terminal and the soldering portion of each power terminal project beyond a rear surface of the base body. Each contact portion has an upper contact plate, a lower contact plate located under the upper contact plate and facing the upper contact plate, and a connecting plate connected between the upper contact plate and the lower contact plate. The lower contact plate is parallel to the upper contact plate. Middles of outer surfaces of the connecting plates of the two ground terminals are exposed to the two opposite side surfaces of the insulating housing. The upper contact plate of each contact portion and the lower contact plate of each contact portion are exposed outside to the top surface of the tongue portion and the bottom surface of the tongue portion to form a contact area on the top surface and the bottom surface of the tongue portion.

Another object of the present invention is to provide an electrical connector. The electrical connector includes an insulating housing and a terminal assembly. The insulating housing has a base body. A middle of a front surface of the base body extends frontward to form a stepping portion. A middle of a front surface of the stepping portion extends frontward to form a tongue portion. The tongue portion has a top surface, a bottom surface, and two opposite side surfaces connected between the top surface and the bottom surface. Two rears of the two opposite side surfaces of the tongue portion of the insulating housing are recessed inward to form two notches. The terminal assembly includes two ground terminals, two power terminals and two detecting terminals fastened to the insulating housing. The two ground terminals are mounted to two outermost portions of two opposite sides of the tongue portion. The two power terminals are mounted to the two opposite sides of the tongue portion. The two detecting terminals are disposed in a middle of the tongue portion, and the two power terminals surround the two detecting terminals. Each of the two ground terminals and the two power terminals has a fastening portion, a contact portion and a soldering portion. The fastening portion of each ground terminal and the fastening portion of each power terminal are fastened in and surrounded by the base body and a rear of the stepping portion of the insulating housing. A front end of the fastening portion of each ground terminal extends frontward to form the contact portion, and a front end of the fastening portion of each power terminal extends frontward to form the contact portion. The contact portion of each ground terminal and the contact portion of each power terminal are surrounded by the tongue portion and a front of the stepping portion of the insulating housing. A rear end of the fastening portion of each ground terminal extends rearward to form the soldering portion, and a rear end of the fastening portion of each power terminal extends rearward to form the soldering portion. The soldering portion of each ground terminal and the soldering portion of each power terminal project beyond a rear surface of the base body. Each contact portion has an upper contact plate, a lower contact plate located under the upper contact plate and facing the upper contact plate, and a connecting plate connected between the upper contact plate and the lower contact plate. The lower contact plate is parallel to the upper contact plate. Middles of outer surfaces of the connecting plates of the two contact portions of the two ground terminals are exposed outside from the two notches of the insulating housing. The upper contact plate of each ground terminal and the upper contact plate of each power terminal are exposed outside to the top surface of the tongue portion. The lower contact plate of each ground terminal and the lower contact plate of each power terminal are exposed outside to the bottom surface of the tongue portion.

As described above, each ground terminal and each power terminal of the electrical connector adopt designs of a single set of the terminals to lower a development cost of the electrical connector, and the contact area of the top surface and the bottom surface of the tongue portion of the insulating housing replaces a contact region which is formed by need of an upper row of the terminals and a lower row of the terminals of the conventional connector, so each ground terminal and each power terminal of the electrical connector may effectively decrease a manufacturing cost of the electrical connector, and the electrical connector has the lower manufacturing cost, in addition, each ground terminal has an insertion and withdrawal resistance function and a ground function, furthermore, a design of the center shielding plate of the conventional connector is omitted so as to further lower the manufacturing cost of the electrical connector, correspondingly, the electrical connector has multiple advantages. As a result, comparing the electrical connector with the conventional connector, the electrical connector has more advantages.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
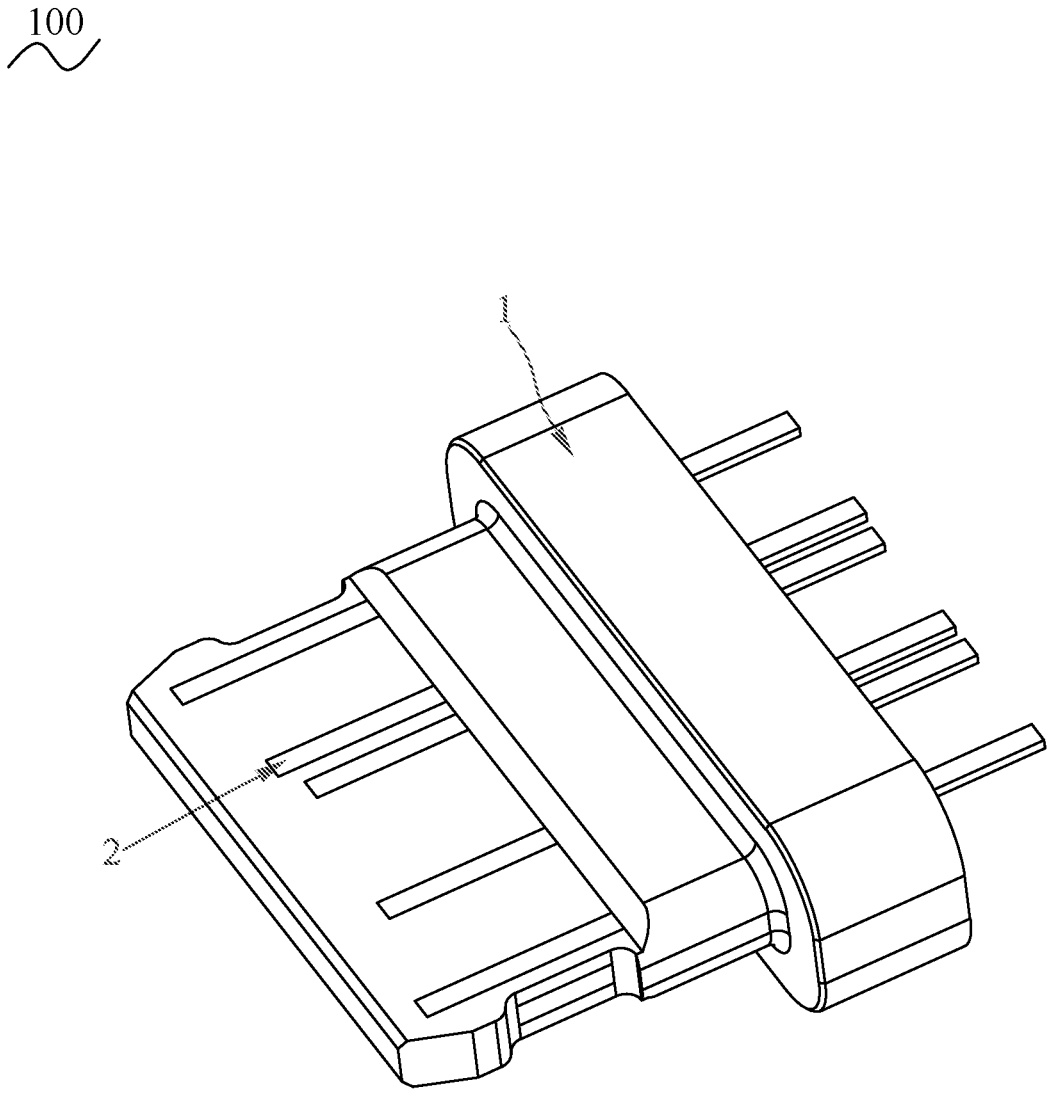
FIG. 1 is a perspective view of an electrical connector in accordance with a preferred embodiment of the present invention.
Figure 2:
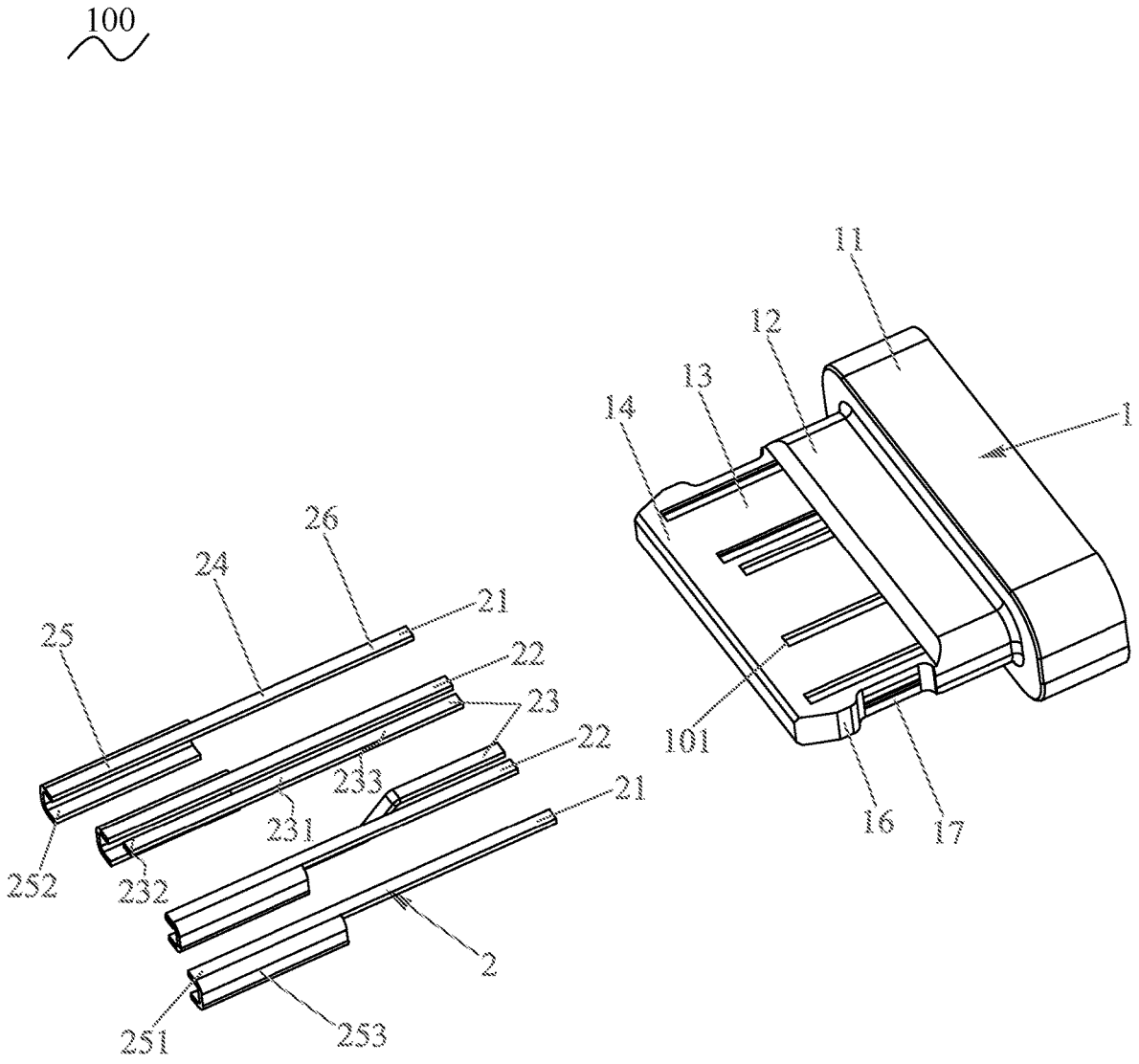
FIG. 2 is an exploded view of the electrical connector of FIG. 1.
Figure 3:
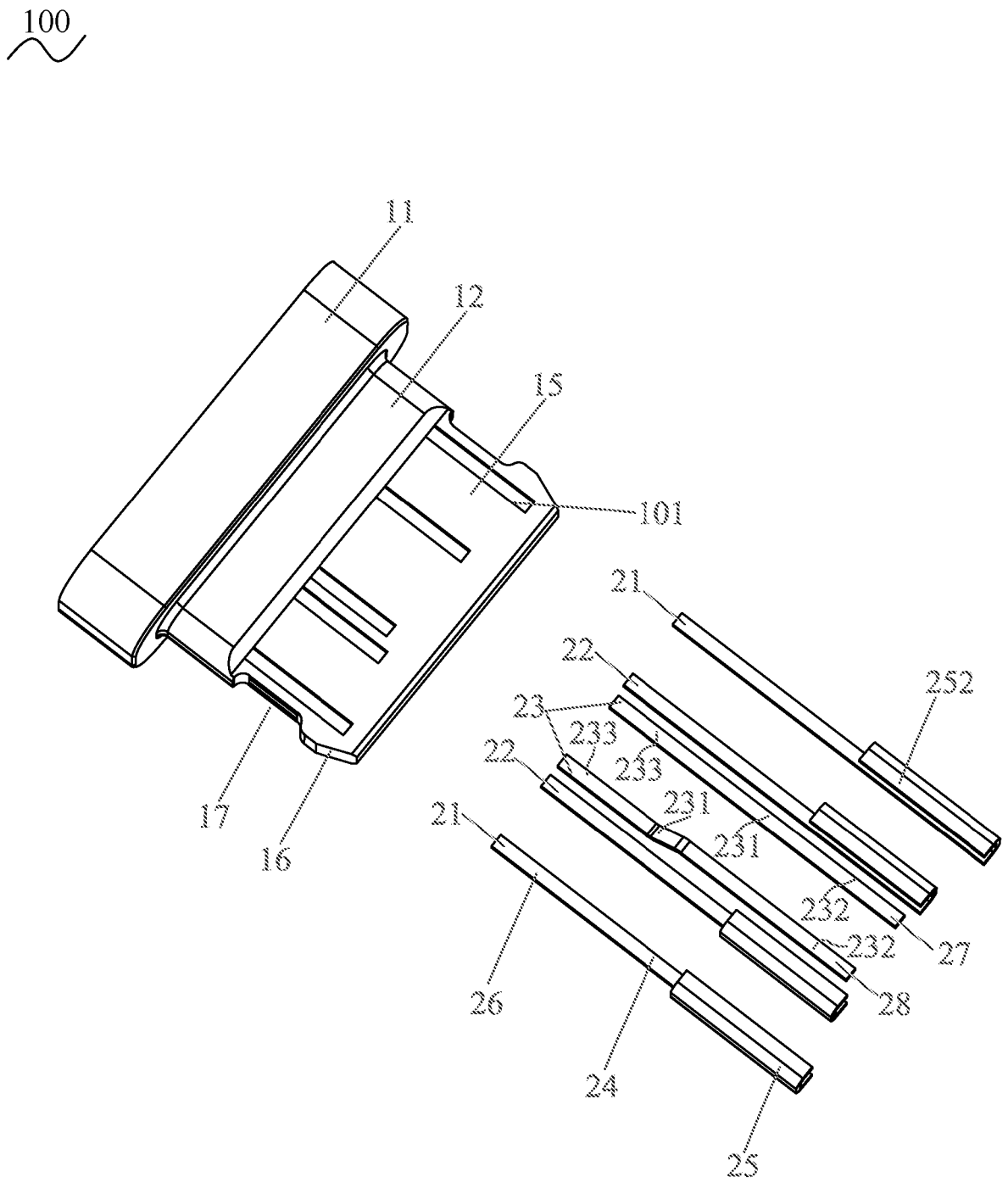
FIG. 3 is another exploded view of the electrical connector of FIG. 1.

With reference to FIG. 1 to FIG. 3, an electrical connector 100 in accordance with a preferred embodiment of the present invention is shown. The electrical connector 100 includes an insulating housing 1 and a terminal assembly 2. The terminal assembly 2 is fastened to the insulating housing 1. The electrical connector 100 is adapted for being docked with a docking connector (not shown). In the preferred embodiment, the electrical connector 100 is a Type-C connector. In another specific preferred embodiment of the present invention, the electrical connector 100 is able to be another type connector which is different from the Type-C connector. In the preferred embodiment, the terminal assembly 2 is integrated with and is disposed in the insulating housing 1 by virtue of an integral injection molding technology.

Referring to FIG. 2 and FIG. 3, the insulating housing 1 has a base body 11, a stepping portion 12 and a tongue portion 13. A middle of a front surface of the base body 11 extends frontward to form the stepping portion 12. A middle of a front surface of the stepping portion 12 extends frontward to form the tongue portion 13. The tongue portion 13 has a top surface 14, a bottom surface 15, and two opposite side surfaces 16 connected between the top surface 14 and the bottom surface 15. The top surface 14 and the bottom surface 15 of the tongue portion 13 are opposite to each other. Each side surface 16 of the tongue portion 13 has a notch 17. In the preferred embodiment, two rears of the two opposite side surfaces 16 of the tongue portion 13 of the insulating housing 1 are recessed inward to form two notches 17. The two opposite side surfaces 16 of the tongue portion 13 are defined as a left surface and a right surface of the tongue portion 13. Rears of the top surface 14, the two opposite side surfaces 16 and the bottom surface 15 of the tongue portion 13 are connected with the front surface of the stepping portion 12. A rear of the stepping portion 12 is connected with the front surface of the base body 11.

With reference to FIG. 1 to FIG. 3, the terminal assembly 2 includes at least two ground terminals 21, at least two power terminals 22 and at least two detecting terminals 23 fastened to the insulating housing 1. The at least two ground terminals 21 are mounted to two outermost portions of two opposite sides of the tongue portion 13. The at least two power terminals 22 are mounted to the two opposite sides of the tongue portion 13. The at least two power terminals 22 are adjacent to inner sides of the at least two ground terminals 21. The at least two ground terminals 21 are disposed in two outermost portions of a left side and a right side of the tongue portion 13, respectively. The at least two power terminals 22 are disposed in the left side and the right side of the tongue portion 13 and are adjacent to the inner sides of the at least two ground terminals 21. The at least two detecting terminals 23 are disposed in a middle of the tongue portion 13, and the at least two power terminals 22 surround the at least two detecting terminals 23. The at least two power terminals 22 are spaced from the at least two detecting terminals 23.

In the preferred embodiment, the terminal assembly 2 includes two ground terminals 21, two power terminals 22 and two detecting terminals 23. The two detecting terminals 23 are located between the two power terminals 22. The two power terminals 22 and the two detecting terminals 23 are located between the two ground terminals 21. The two ground terminals 21 are mounted to the two outermost portions of the two opposite sides of the tongue portion 13. The two power terminals 22 are mounted to the two opposite sides of the tongue portion 13. The two power terminals 22 are adjacent to inner sides of the two ground terminals 21. The two ground terminals 21 are disposed in the two outermost portions of the left side and the right side of the tongue portion 13, respectively. The two power terminals 22 are disposed in the left side and the right side of the tongue portion 13 and are adjacent to the inner sides of the two ground terminals 21. The two detecting terminals 23 are disposed in the middle of the tongue portion 13, and the two power terminals 22 surround the two detecting terminals 23.

In the preferred embodiment, the two ground terminals 21 are able to replace the center shielding plate of the conventional connector (not shown) to be buckled with the metal buckling arms of the mating connector (not shown) in prior art, so each ground terminal 21 has an insertion and withdrawal resistance function and a ground function. Each detecting terminal 23 is used for detecting whether the electrical connector 100 is assembled with and is paired with the docking connector successfully. In the preferred embodiment, the two ground terminals 21, the two power terminals 22 and the two detecting terminals 23 have the same coplanarity. Fronts of top surfaces of the two ground terminals 21, the two power terminals 22 and one detecting terminal 23 are coplanar. Fronts of bottom surfaces of the two ground terminals 21, the two power terminals 22 and the other detecting terminal 23 are coplanar.

Each of the at least two ground terminals 21 and the at least two power terminals 22 has a fastening portion 24, a contact portion 25 and a soldering portion 26. Each of the two ground terminals 21 and the two power terminals 22 has the fastening portion 24, the contact portion 25 and the soldering portion 26. A rear end of the fastening portion 24 of each of the at least two ground terminals 21 and the at least two power terminals 22 horizontally extends rearward to form the soldering portion 26. A front end of the fastening portion 24 of each of the at least two ground terminals 21 and the at least two the power terminals 22 extends frontward to form the contact portion 25. In each ground terminal 21 and each power terminal 22, the fastening portion 24 is connected between the contact portion 25 and the soldering portion 26. The fastening portion 24 of each ground terminal 21 and the fastening portion 24 of each power terminal 22 are fastened in and surrounded by the base body 11 and a rear of the stepping portion 12 of the insulating housing 1. A front end of the fastening portion 24 of each ground terminal 21 extends frontward to form the contact portion 25, and a front end of the fastening portion 24 of each power terminal 22 extends frontward to form the contact portion 25. The contact portion 25 of each ground terminal 21 and the contact portion 25 of each power terminal 22 are surrounded by the tongue portion 13 and a front of the stepping portion 12 of the insulating housing 1. A rear end of the fastening portion 24 of each ground terminal 21 extends rearward to form the soldering portion 26, and a rear end of the fastening portion 24 of each power terminal 22 extends rearward to form the soldering portion 26. The soldering portion 26 of each ground terminal 21 and the soldering portion 26 of each power terminal 22 extend out of a rear end of the base body 11 and project beyond the rear surface of the base body 11.

Each contact portion 25 has an upper contact plate 251, a lower contact plate 252 located under the upper contact plate 251 and facing the upper contact plate 251, and a connecting plate 253 connected between the upper contact plate 251 and the lower contact plate 252. Specifically, the contact portion 25 of each ground terminal 21 has the upper contact plate 251, the lower contact plate 252 located under the upper contact plate 251 and facing the upper contact plate 251, and the connecting plate 253 connected between the upper contact plate 251 and the lower contact plate 252. The contact portion 25 of each power terminal 22 has the upper contact plate 251, the lower contact plate 252 located under the upper contact plate 251 and facing the upper contact plate 251, and the connecting plate 253 connected between the upper contact plate 251 and the lower contact plate 252. Two opposite side edges of the connecting plate 253 are perpendicularly connected with one side edge of the upper contact plate 251 and one side edge of the lower contact plate 252. In each contact portion 25, a bottom edge and a top edge of the connecting plate 253 are perpendicularly connected between an outer side edge of the upper contact plate 251 and an outer side edge of the lower contact plate 252. Outer surfaces and inner surfaces of the upper contact plate 251, the lower contact plate 252 and the connecting plate 253 of each contact portion 25 are connected smoothly. The connecting plate 253 is perpendicularly connected between the upper contact plate 251 and the lower contact plate 252.

Middles of outer surfaces of the connecting plates 253 of the two contact portions 25 of the two ground terminals 21 are exposed to the two opposite side surfaces 16 of the insulating housing 1. The middles of the outer surfaces of the connecting plates 253 of the two contact portions 25 of the two ground terminals 21 are exposed outside from the two notches 17 of the insulating housing 1. The upper contact plate 251 of the contact portion 25 of each ground terminal 21 and the upper contact plate 251 of the contact portion 25 of each power terminal 22 are exposed outside to the top surface 14 of the tongue portion 13 of the insulating housing 1. The lower contact plate 252 of the contact portion 25 of each ground terminal 21 and the lower contact plate 252 of the contact portion 25 of each power terminal 22 are exposed outside to the bottom surface 15 of the tongue portion 13 of insulating housing 1. In the preferred embodiment, the upper contact plate 251, the connecting plate 253 and lower contact plate 252 of each contact portion 25 are connected to form a C shape structure seen from a front view or a rear view.

A front end of each fastening portion 24 extends frontward to form the elongated upper contact plate 251. The outer side edge of the upper contact plate 251 of each fastening portion 24 is bent downward to form the connecting plate 253. The bottom edge of the connecting plate 253 of each fastening portion 24 is bent inward to form the lower contact plate 252 facing a bottom surface of the upper contact plate 251. The lower contact plate 252 is located under the upper contact plate 251. The lower contact plate 252 is parallel to the upper contact plate 251. The lower contact plate 252 is spaced from the upper contact plate 251. The upper contact plate 251 and the lower contact plate 252 of each contact portion 25 are disposed horizontally. The connecting plate 253 of each contact portion 25 is disposed vertically.

In the preferred embodiment, the front end of the fastening portion 24 of each ground terminal 21 extends frontward to form the elongated upper contact plate 251, and the front end of the fastening portion 24 of each power terminal 22 extends frontward to form the upper contact plate 251. The outer side edge of the upper contact plate 251 of the fastening portion 24 of each ground terminal 21 is bent downward to form the connecting plate 253. The outer side edge of the upper contact plate 251 of the fastening portion 24 of each power terminal 22 is bent downward to form the connecting plate 253. The two bottom edges of the two connecting plates 253 of the two fastening portions 24 of the two ground terminals 21 are bent inward and extend towards the two power terminals 22 to form two lower contact plates 252. The two bottom edges of the two connecting plates 253 of the two fastening portions 24 of the two power terminals 22 are bent inward and extend towards the two detecting terminals 23 of the terminal assembly 2 to form another two lower contact plates 252. The upper contact plates 251 and the lower contact plates 252 of the two ground terminals 21 and the two power terminals 22 are parallel.

The upper contact plate 251 and the lower contact plate 252 of the contact portion 25 of each ground terminal 21 are disposed horizontally. The connecting plate 253 of the contact portion 25 of each ground terminal 21 is disposed vertically. In the contact portion 25 of each ground terminal 21, two opposite side edges of the connecting plate 253 are perpendicularly connected between the outer side edge of the upper contact plate 251 and the outer side edge of the lower contact plate 252, and in the contact portion 25 of each power terminal 22, the two opposite side edges of the connecting plate 253 are perpendicularly connected between the outer side edge of the upper contact plate 251 and the outer side edge of the lower contact plate 252. Comparing the electrical connector 100 in accordance with the present invention with the conventional connector, the conventional connector includes the upper row of terminals and the lower row of terminals, or the conventional connector includes the integrally formed terminal, nevertheless, the conventional connector needs the multiple processes for surrounding the terminal to cause the complicated working procedure and the higher cost.

Each ground terminal 21 and each power terminal 22 adopt designs of single set of terminals to lower a development cost of the electrical connector 100. Furthermore, the upper contact plate 251 of each contact portion 25 and the lower contact plate 252 of each contact portion 25 are exposed outside to the top surface 14 of the tongue portion 13 and the bottom surface 15 of the tongue portion 13 to form a contact area 101 on the top surface 14 and the bottom surface 15 of the tongue portion 13. The contact area 101 of the top surface 14 and the bottom surface 15 of the tongue portion 13 of the insulating housing 1 replaces the contact region which is formed by need of the upper row of the terminals and the lower row of the terminals of the conventional connector, so each ground terminal 21 and each power terminal 22 of the electrical connector 100 may effectively decrease a manufacturing cost of the electrical connector 100. In addition, the middles of the outer surfaces of the two connecting plates 253 of the two contact portions 25 of the two ground terminals 21 are exposed outside to the two notches 17 to replace the center shielding plate of the conventional connector to be buckled with the metal buckling arms of the mating connector in the prior art, so each ground terminal 21 has the insertion and withdrawal resistance function and the ground function. Furthermore, a design of the center shielding plate of the conventional connector is omitted so as to further lower the manufacturing cost of the electrical connector 100.

In the preferred embodiment, the two detecting terminals 23 include a first detecting terminal 27 and a second detecting terminal 28. The first detecting terminal 27 is a straight flat shape. Each detecting terminal 23 has a fastening section 231, a contact section 232 and a soldering section 233. The fastening section 231 of each detecting terminal 23 is connected between the contact section 232 and the soldering section 233 of each detecting terminal 23. The fastening section 231 of each detecting terminal 23 is fastened in and surrounded by the base body 11 and the rear of the stepping portion 12 of the insulating housing 1, two contact sections 232 of the at least two detecting terminals 23 are exposed to the top surface 14 and the bottom surface 15 of the tongue portion 13, the soldering section 233 of each detecting terminal 23 extends out of the rear end of the base body 11 and projects beyond the rear surface of the base body 11. The first detecting terminal 27 has the fastening section 231. A front end of the fastening section 231 of the first detecting terminal 27 extends frontward to form the contact section 232. A rear end of the fastening section 231 of the first detecting terminal 27 horizontally extends rearward to form the soldering section 233. A top surface of the contact section 232 of the first detecting terminal 27 is exposed outside to the top surface 14 of the tongue portion 13 of insulating housing 1.

The second detecting terminal 28 has the fastening section 231. The fastening section 231 of the second detecting terminal 28 is shown as a substantially Z shape. A middle of the substantially Z-shaped fastening section 231 of the second detecting terminal 28 slantwise extends rearward and downward from front to rear. A front end of the fastening section 231 of the second detecting terminal 28 horizontally extends frontward to form the contact section 232. A rear end of the fastening section 231 of the second detecting terminal 28 extends rearward to form the soldering section 233. A bottom surface of the contact section 232 of the second detecting terminal 28 is exposed to the bottom surface 15 of the tongue portion 13 of the insulating housing 1.

The soldering portions 26 of the at least two ground terminals 21 and the at least two power terminals 22, and the soldering sections 233 of the at least two detecting terminals 23 are abreast arranged in a row and along a transverse direction. Top surfaces of the soldering portions 26 of the at least two ground terminals 21 and the at least two power terminals 22, and the soldering sections 233 of the at least two detecting terminals 23 are flush and are on the same plane. Bottom surfaces of the soldering portions 26 of the at least two ground terminals 21 and the at least two power terminals 22, and the soldering sections 233 of the at least two detecting terminals 23 are flush and are on the same level. The soldering portions 26 of the two ground terminals 21, the soldering portions 26 of the two power terminals 22 and the soldering sections 233 of the two detecting terminals 23 are abreast arranged in the row and along the transverse direction. The top surfaces of the soldering portions 26 of the two ground terminals 21, the soldering portions 26 of the two power terminals 22 and the soldering sections 233 of the two detecting terminals 23 are flush and are on the same plane. The bottom surfaces of the soldering portions 26 of the two ground terminals 21, the soldering portions 26 of the two power terminals 22 and the soldering sections 233 of the two detecting terminals 23 are flush and are on the same level.

The electrical connector 100 only has a charging function and is without a signal transmission function.

As described above, each ground terminal 21 and each power terminal 22 of the electrical connector 100 adopt the designs of the single set of the terminals to lower the development cost of the electrical connector 100, and the contact area 101 of the top surface 14 and the bottom surface 15 of the tongue portion 13 of the insulating housing 1 replaces the contact region which is formed by need of the upper row of the terminals and the lower row of the terminals of the conventional connector, so each ground terminal 21 and each power terminal 22 of the electrical connector 100 may effectively decrease the manufacturing cost of the electrical connector 100, and the electrical connector 100 has the lower manufacturing cost, in addition, each ground terminal 21 has the insertion and withdrawal resistance function and the ground function, furthermore, the design of the center shielding plate of the conventional connector is omitted so as to further lower the manufacturing cost of the electrical connector 100, correspondingly, the electrical connector 100 has multiple advantages. As a result, comparing the electrical connector 100 with the conventional connector, the electrical connector 100 has more advantages.

What is claimed is:

1. An electrical connector with connected contact portions on upper surfaces and lower surfaces of a tongue portion, comprising:

an insulating housing having a base body, a middle of a front surface of the base body extending frontward to form a stepping portion, a middle of a front surface of the stepping portion extending frontward to form a tongue portion, the tongue portion having a top surface, a bottom surface, and two opposite side surfaces connected between the top surface and the bottom surface, the top surface and the bottom surface being opposite to each other; and a terminal assembly including at least two ground terminals, at least two power terminals and at least two detecting terminals fastened to the insulating housing, the at least two ground terminals being mounted to two outermost portions of two opposite sides of the tongue portion, the at least two power terminals being mounted to the two opposite sides of the tongue portion, the at least two detecting terminals being disposed in a middle of the tongue portion, and the at least two power terminals surrounding the at least two detecting terminals, each of the at least two ground terminals and the at least two power terminals having a fastening portion, a contact portion and a soldering portion, the fastening portion of each ground terminal and the fastening portion of each power terminal being fastened in and surrounded by the base body and a rear of the stepping portion of the insulating housing, a front end of the fastening portion of each ground terminal extending frontward to form the contact portion, and a front end of the fastening portion of each power terminal extending frontward to form the contact portion, the contact portion of each ground terminal and the contact portion of each power terminal being surrounded by the tongue portion and a front of the stepping portion of the insulating housing, a rear end of the fastening portion of each ground terminal extending rearward to form the soldering portion, and a rear end of the fastening portion of each power terminal extending rearward to form the soldering portion, the soldering portion of each ground terminal and the soldering portion of each power terminal extending out of a rear end of the base body and projecting beyond a rear surface of the base body, each contact portion of the power and ground terminals having an upper contact plate, a lower contact plate located under the upper contact plate and facing the upper contact plate, and a connecting plate connected between the upper contact plate and the lower contact plate, the lower contact plate being parallel to the upper contact plate, middles of outer surfaces of the connecting plates of the two ground terminals being exposed to the two opposite side surfaces of the insulating housing, the upper contact plate of each ground terminal and the upper contact plate of each power terminal being exposed outside to the top surface of the tongue portion, the lower contact plate of each ground terminal and the lower contact plate of each power terminal being exposed outside to the bottom surface of the tongue portion.

2. The electrical connector with connected contact portions on upper surfaces and lower surfaces of a tongue portion as claimed in claim 1, wherein the upper contact plate, the connecting plate and lower contact plate of each contact portion of the power and ground terminals are connected to form a C shape structure.

3. The electrical connector with connected contact portions on upper surfaces and lower surfaces of a tongue portion as claimed in claim 1, wherein the connecting plate is perpendicularly connected between the upper contact plate and the lower contact plate.

4. The electrical connector with connected contact portions on upper surfaces and lower surfaces of a tongue portion as claimed in claim 1, wherein in the contact portion of each ground terminal and in the contact portion of each power terminal, two opposite side edges of the connecting plate are perpendicularly connected between an outer side edge of the upper contact plate and an outer side edge of the lower contact plate.

5. The electrical connector with connected contact portions on upper surfaces and lower surfaces of a tongue portion as claimed in claim 1, wherein a front end of each fastening portion extends frontward to form the elongated upper contact plate, an outer side edge of the upper contact plate of each fastening portion is bent downward to form the connecting plate, a bottom edge of the connecting plate of each fastening portion is bent inward to form the lower contact plate facing a bottom surface of the upper contact plate, the lower contact plate is spaced from the upper contact plate, the upper contact plate and the lower contact plate of each contact portion of the power and ground terminals are disposed horizontally, the connecting plate of each contact portion of the power and ground terminals is disposed vertically.

6. The electrical connector with connected contact portions on upper surfaces and lower surfaces of a tongue portion as claimed in claim 1, wherein the rear end of the fastening portion of each of the at least two ground terminals and the at least two power terminals horizontally extends rearward to form the soldering portion.

7. The electrical connector with connected contact portions on upper surfaces and lower surfaces of a tongue portion as claimed in claim 1, wherein the soldering portions of the at least two ground terminals and the power terminals are abreast arranged in a row, top surfaces of the soldering portions of the at least two ground terminals and the power terminals are on the same plane, bottom surfaces of the soldering portions of the at least two ground terminals and the power terminals are on the same level.

8. The electrical connector with connected contact portions on upper surfaces and lower surfaces of a tongue portion as claimed in claim 1, wherein the at least two ground terminals are disposed in two outermost portions of a left side and a right side of the tongue portion, respectively, the at least two power terminals are disposed in the left side and the right side of the tongue portion and are adjacent to inner sides of the at least two ground terminals, the at least two detecting terminals are disposed in the middle of the tongue portion, and the at least two power terminals surround the at least two detecting terminals, the at least two power terminals are spaced from the at least two detecting terminals.

9. The electrical connector with connected contact portions on upper surfaces and lower surfaces of a tongue portion as claimed in claim 1, wherein each detecting terminal has a fastening section, a contact section and a soldering section, the fastening section of each detecting terminal is connected between the contact section and the soldering section of each detecting terminal, the fastening section of each detecting terminal is fastened in and surrounded by the base body and the rear of the stepping portion of the insulating housing, two contact sections of the at least two detecting terminals are exposed to the top surface and the bottom surface of the tongue portion, the soldering section of each detecting terminal extends out of the rear end of the base body and projects beyond the rear surface of the base body.

10. The electrical connector with connected contact portions on upper surfaces and lower surfaces of a tongue portion as claimed in claim 9, wherein the soldering portions of the at least two ground terminals and the at least two power terminals, and the soldering sections of the at least two detecting terminals are abreast arranged in a row and along a transverse direction, top surfaces of the soldering portions of the at least two ground terminals and the at least two power terminals, and the soldering sections of the at least two detecting terminals are on the same plane, bottom surfaces of the soldering portions of the at least two ground terminals and the at least two power terminals, and the soldering sections of the at least two detecting terminals are on the same level.

11. The electrical connector with connected contact portions on upper surfaces and lower surfaces of a tongue portion as claimed in claim 9, wherein the terminal assembly includes two detecting terminals, the two detecting terminals include a first detecting terminal and a second detecting terminal, the first detecting terminal is a straight flat shape, the first detecting terminal has the fastening section, a front end of the fastening section of the first detecting terminal extends frontward to form the contact section, a rear end of the fastening section of the first detecting terminal extends rearward to form the soldering section, a top surface of the contact section of the first detecting terminal is exposed outside to the top surface of the tongue portion of insulating housing, the second detecting terminal has the fastening section shown as a substantially Z shape, a middle of the substantially Z-shaped fastening section of the second detecting terminal slantwise extends rearward and downward from front to rear, a front end of the fastening section of the second detecting terminal horizontally extends frontward to form the contact section, a rear end of the fastening section of the second detecting terminal horizontally extends rearward to form the soldering section, a bottom surface of the contact section of the second detecting terminal is exposed to the bottom surface of the tongue portion of the insulating housing.

12. The electrical connector with connected contact portions on upper surfaces and lower surfaces of a tongue portion as claimed in claim 1, wherein the terminal assembly includes two ground terminals, two power terminals and two detecting terminals, the two detecting terminals are located between the two power terminals, the two power terminals and the two detecting terminals are located between the two ground terminals.

13. The electrical connector with connected contact portions on upper surfaces and lower surfaces of a tongue portion as claimed in claim 12, wherein the two ground terminals, the two power terminals and the two detecting terminals have the same coplanarity, fronts of top surfaces of the two ground terminals, the two power terminals and one detecting terminal are coplanar, fronts of bottom surfaces of the two ground terminals, the two power terminals and the other detecting terminal are coplanar.

14. The electrical connector with connected contact portions on upper surfaces and lower surfaces of a tongue portion as claimed in claim 12, wherein two bottom side edges of the two connecting plates of the two fastening portions of the two ground terminals are bent inward and extend towards the two power terminals to form two lower contact plates.

15. The electrical connector with connected contact portions on upper surfaces and lower surfaces of a tongue portion as claimed in claim 12, wherein two rears of the two opposite side surfaces of the tongue portion of the insulating housing are recessed inward to form two notches, the middles of the outer surfaces of the connecting plates of the two contact portions of the two ground terminals are exposed outside from the two notches of the insulating housing.

16. The electrical connector with connected contact portions on upper surfaces and lower surfaces of a tongue portion as claimed in claim 12, wherein each detecting terminal has a soldering section, the soldering portions of the two ground terminals, the soldering portions of the two power terminals and the soldering sections of the two detecting terminals are abreast arranged in a row and along a transverse direction, top surfaces of the soldering portions of the two ground terminals, the soldering portions of the two power terminals and the soldering sections of the two detecting terminals are flush and are on the same plane, bottom surfaces of the soldering portions of the two ground terminals, the soldering portions of the two power terminals and the soldering sections of the two detecting terminals are flush and are on the same level.

17. The electrical connector with connected contact portions on upper surfaces and lower surfaces of a tongue portion as claimed in claim 1, wherein in each contact portion of the power and ground terminals, a bottom edge and a top edge of the connecting plate are perpendicularly connected between an outer side edge of the upper contact plate and an outer side edge of the lower contact plate, outer surfaces and inner surfaces of the upper contact plate, the lower contact plate and the connecting plate of each contact portion of the power and ground terminals are connected smoothly.

18. The electrical connector with connected contact portions on upper surfaces and lower surfaces of a tongue portion as claimed in claim 1, wherein in each ground terminal and each power terminal, the fastening portion is connected between the contact portion and the soldering portion, two opposite side edges of the connecting plate are perpendicularly connected with one side edge of the upper contact plate and one side edge of the lower contact plate.

19. An electrical connector with connected contact portions on upper surfaces and lower surfaces of a tongue portion, comprising:

an insulating housing having a base body, a middle of a front surface of the base body extending frontward to form a stepping portion, a middle of a front surface of the stepping portion extending frontward to form a tongue portion, the tongue portion having a top surface, a bottom surface, and two opposite side surfaces connected between the top surface and the bottom surface; and a terminal assembly including at least two ground terminals, at least two power terminals and at least two detecting terminals fastened to the insulating housing, the at least two ground terminals being mounted to two outermost portions of two opposite sides of the tongue portion, the at least two power terminals being mounted to the two opposite sides of the tongue portion, the at least two detecting terminals being disposed in a middle of the tongue portion, and the at least two power terminals surrounding the at least two detecting terminals, each of the at least two ground terminals and the at least two power terminals having a fastening portion, a contact portion and a soldering portion, the fastening portion of each ground terminal and the fastening portion of each power terminal being fastened in and surrounded by the base body and a rear of the stepping portion of the insulating housing, a front end of the fastening portion of each ground terminal extending frontward to form the contact portion, and a front end of the fastening portion of each power terminal extending frontward to form the contact portion, the contact portion of each ground terminal and the contact portion of each power terminal being surrounded by the tongue portion and a front of the stepping portion of the insulating housing, a rear end of the fastening portion of each ground terminal extending rearward to form the soldering portion, and a rear end of the fastening portion of each power terminal extending rearward to form the soldering portion, the soldering portion of each ground terminal and the soldering portion of each power terminal projecting beyond a rear surface of the base body, each contact portion of the power and ground terminals having an upper contact plate, a lower contact plate located under the upper contact plate and facing the upper contact plate, and a connecting plate connected between the upper contact plate and the lower contact plate, the lower contact plate being parallel to the upper contact plate, middles of outer surfaces of the connecting plates of the two ground terminals being exposed to the two opposite side surfaces of the insulating housing, the upper contact plate of each contact portion of the power and ground terminals and the lower contact plate of each contact portion of the power and ground terminals being exposed outside to the top surface of the tongue portion and the bottom surface of the tongue portion to form a contact area on the top surface and the bottom surface of the tongue portion.

20. An electrical connector with connected contact portions on upper surfaces and lower surfaces of a tongue portion, comprising:

an insulating housing having a base body, a middle of a front surface of the base body extending frontward to form a stepping portion, a middle of a front surface of the stepping portion extending frontward to form a tongue portion, the tongue portion having a top surface, a bottom surface, and two opposite side surfaces connected between the top surface and the bottom surface, two rears of the two opposite side surfaces of the tongue portion of the insulating housing being recessed inward to form two notches; and a terminal assembly including two ground terminals, two power terminals and two detecting terminals fastened to the insulating housing, the two ground terminals being mounted to two outermost portions of two opposite sides of the tongue portion, the two power terminals being mounted to the two opposite sides of the tongue portion, the two detecting terminals being disposed in a middle of the tongue portion, and the two power terminals surrounding the two detecting terminals, each of the two ground terminals and the two power terminals having a fastening portion, a contact portion and a soldering portion, the fastening portion of each ground terminal and the fastening portion of each power terminal being fastened in and surrounded by the base body and a rear of the stepping portion of the insulating housing, a front end of the fastening portion of each ground terminal extending frontward to form the contact portion, and a front end of the fastening portion of each power terminal extending frontward to form the contact portion, the contact portion of each ground terminal and the contact portion of each power terminal being surrounded by the tongue portion and a front of the stepping portion of the insulating housing, a rear end of the fastening portion of each ground terminal extending rearward to form the soldering portion, and a rear end of the fastening portion of each power terminal extending rearward to form the soldering portion, the soldering portion of each ground terminal and the soldering portion of each power terminal projecting beyond a rear surface of the base body, each contact portion of the power and ground terminals having an upper contact plate, a lower contact plate located under the upper contact plate and facing the upper contact plate, and a connecting plate connected between the upper contact plate and the lower contact plate, the lower contact plate being parallel to the upper contact plate, middles of outer surfaces of the connecting plates of the two contact portions of the two ground terminals being exposed outside from the two notches of the insulating housing, the upper contact plate of each ground terminal and the upper contact plate of each power terminal being exposed outside to the top surface of the tongue portion, the lower contact plate of each ground terminal and the lower contact plate of each power terminal being exposed outside to the bottom surface of the tongue portion.

* * * * *